US010537150B2

(12) United States Patent
Bruel

(10) Patent No.: US 10,537,150 B2
(45) Date of Patent: Jan. 21, 2020

(54) MOVEMENT ASSISTANCE DEVICE

(71) Applicant: APLINOV, Veurey-Voroize (FR)

(72) Inventor: Michel Bruel, Veurey-voroize (FR)

(73) Assignee: Aplinov, Veurey-Voroize (FR)

( * ) Notice: Subject to any disclaimer, the term of this patent is extended or adjusted under 35 U.S.C. 154(b) by 0 days.

(21) Appl. No.: 15/567,008

(22) PCT Filed: Apr. 5, 2016

(86) PCT No.: PCT/FR2016/050773
§ 371 (c)(1),
(2) Date: Oct. 16, 2017

(87) PCT Pub. No.: WO2016/166442
PCT Pub. Date: Oct. 20, 2016

(65) Prior Publication Data

US 2018/0125152 A1 May 10, 2018

(30) Foreign Application Priority Data

Apr. 16, 2015 (FR) ..... 15 53382

(51) Int. Cl.
*A43B 7/14* (2006.01)
*A63C 9/08* (2012.01)
(Continued)

(52) U.S. Cl.
CPC ..... *A43B 7/147* (2013.01); *A43B 5/0452* (2013.01); *A43B 7/16* (2013.01); *A43B 7/32* (2013.01);
(Continued)

(58) Field of Classification Search
CPC ..... A43B 7/147; A43B 5/0452; A43B 5/0462; A43B 5/0468; A43B 5/047; A63C 5/08; A63C 5/06; A63C 9/006
See application file for complete search history.

(56) References Cited

U.S. PATENT DOCUMENTS 4,152,007 A * 5/1979 Smith ..... A63C 7/1086 188/6
5,282,325 A 2/1994 Beyl
(Continued)

FOREIGN PATENT DOCUMENTS

EP 1637113 3/2006
EP 2554150 2/2013
(Continued)

OTHER PUBLICATIONS

International Search Report for International Application No. PCT/FR2016/050773 dated Jun. 6, 2016, 3 pages.
(Continued)

*Primary Examiner* — Brian L Swenson
(74) *Attorney, Agent, or Firm* — TraskBritt

(57) ABSTRACT

A movement assistance device comprising a first element for rigidly connecting the device to one foot of a user and transmitting a thrust force to said foot; and a second element linked to the first element by link means and intended to be in contact with the ground; the device further comprises means for transmitting a force from an exogenous energy source, to the first element and/or to the second element, in order to separate them from each other.

14 Claims, 5 Drawing Sheets

(51) Int. Cl.

| | |
|---|---|
| ***A63B 25/10*** | (2006.01) |
| ***A63B 21/02*** | (2006.01) |
| ***A63C 9/00*** | (2012.01) |
| ***A61H 3/00*** | (2006.01) |
| ***A63B 21/008*** | (2006.01) |
| ***A63C 9/082*** | (2012.01) |
| ***A61H 1/02*** | (2006.01) |
| ***A63C 5/08*** | (2006.01) |
| ***A43B 21/28*** | (2006.01) |
| ***A43B 5/04*** | (2006.01) |
| ***A43B 7/16*** | (2006.01) |
| ***A43B 7/32*** | (2006.01) |
| *A61H 3/04* | (2006.01) |

(52) U.S. Cl.

CPC ..... *A43B 21/285* (2013.01); *A61H 1/0266* (2013.01); *A61H 3/00* (2013.01); *A63B 21/008* (2013.01); *A63B 21/02* (2013.01); *A63B 25/10* (2013.01); *A63C 5/08* (2013.01); *A63C 9/006* (2013.01); *A63C 9/082* (2013.01); *A63C 9/0807* (2013.01); *A61H 3/04* (2013.01); *A61H 2003/007* (2013.01); *A61H 2201/1238* (2013.01); *A61H 2201/164* (2013.01); *A61H 2201/165* (2013.01); *A61H 2201/5064* (2013.01); *A61H 2201/5069* (2013.01)

(56) References Cited

U.S. PATENT DOCUMENTS

| | | | | |
|---|---|---|---|---|
| 5,662,186 | A * | 9/1997 | Welch | A63C 5/08 180/181 |
| 6,684,531 | B2 | 2/2004 | Rennex | |
| 9,032,646 | B2 * | 5/2015 | Perenich | A43B 13/181 36/102 |
| 9,247,784 | B2 * | 2/2016 | Stewart | A43B 13/14 |
| 9,339,718 | B2 * | 5/2016 | Cornillon | A63B 25/10 |
| 2002/0083616 | A1 | 7/2002 | Hajianpour | |
| 2007/0000154 | A1 * | 1/2007 | DiBenedetto | A43B 1/0036 36/132 |
| 2009/0014042 | A1 | 1/2009 | Ashihara et al. | |
| 2010/0210983 | A1 * | 8/2010 | Baker | A43B 7/1445 601/152 |
| 2013/0119622 | A1 | 5/2013 | Othman | |
| 2013/0340287 | A1 | 12/2013 | Stewart | |
| 2017/0014297 | A1 * | 1/2017 | Grygorowicz | B25J 9/0006 |

FOREIGN PATENT DOCUMENTS

| | | | |
|---|---|---|---|
| EP | 2699323 | | 2/2014 |
| FR | 2338720 | A1 | 8/1977 |
| FR | 2845894 | | 4/2004 |
| FR | 2972906 | | 9/2012 |
| FR | 2974308 | A1 | 10/2012 |
| WO | 2009030017 | A1 | 3/2009 |
| WO | 2009097589 | A1 | 8/2009 |

OTHER PUBLICATIONS

International Written Opinion for International Application No. PCT/FR2016/050773 dated Jun. 6, 2016, 6 pages.

* cited by examiner

MOVEMENT ASSISTANCE DEVICE

CROSS-REFERENCE TO RELATED APPLICATIONS

This application is a national phase entry under 35 U.S.C. § 371 of international Patent Application PCT/FR2016/050773, filed, Apr. 16, 2015, designating the United States of America and published as International Patent Publication WO 2016/166442 A1 filed on Apr. 5, 2016, which claims the benefit under Article 8 of the Patent Cooperation Treaty and under 35 § 119(e) to French Patent Application Serial No. 1553382, filed Apr. 16, 2015, the disclosure of each of which is hereby incorporated herein in its entirety by this reference.

TECHNICAL FIELD

This disclosure relates to the field of mobility assistance. More specifically, this disclosure relates to a mobility assistance device, wherein progression is effected by steps that are walked, run or sliding.

BACKGROUND

Many devices have been developed in the field of mobility assistance to help people with reduced mobility or provide relief for those who are temporarily disabled and in the rehabilitation phase, or indeed to assist hikers on difficult terrain.

The simplest and best known devices include ambulation devices such as plain walking sticks, crutches, elbow-support crutches, mountaineering sticks and wheeled walkers. These devices comprise a manual gripping member and an elongated section, the end of which is designed to bear on the ground; they can be used singly, or in pairs in some cases. Document FR2845894 describes for example, a device characterized by the fact that it comprises a means of elastic energy restitution designed to propel the elongated section (of a walking stick, for example) forwards upon lifting the lower end off the ground, releasing the elastic energy accumulated through hand pressure on the manual gripping member.

These devices are simple and readily obtainable, but do not assist movement of the lower limbs.

Assisted movement of the lower limbs is particularly developed in "exoskeleton" devices. Thus, document EP1637113 mentions a walking aid device equipped on the one hand with a system for generating hip joint rotational power serving to impart an auxiliary force to the movement of a lower limb and on the other hand, with a system for generating knee joint rotational power. Both systems are interconnected. The device comprising these systems in addition to means for fastening to the human body are carried around the user's waist and on the sides of his/her lower limbs.

Document EP2554150 mentions another type of device, integral with the user's lower limb, comprising hip, leg and foot units in addition to joint units, interconnected and situated on the front and outer side of the lower limb.

Document US20090014042 describes another type of device, intended to reduce the burden on the user's legs. This device is held on the user's crotch and legs, with the mechanical and linking systems being situated between both lower limbs.

These devices have the disadvantage of being difficult and cumbersome to use, as they are not easy to put on, wear and remove.

Other simpler devices are provided on the user's shoe. Document FR2972906 describes a shoe comprising an upper and a sole, wherein this sole comprises two main sections articulated together. These two sections are articulated along a first horizontal transverse axis located substantially under the natural joint between the forefoot and the posterior part of the foot. A system consisting of spring-loaded lever arms, hinge pins and an elastic module (forming a shock absorber) gives the shoe the characteristic of: (1) transforming the kinetic energy into potential energy when the shoe hits the ground by placing the elastic module under pressure (2) keeping the module under pressure during the phase in which the foot is resting on the ground, (3) releasing the elastic module during the propulsion phase (when the foot is raised to take another step).

Documents U.S. Pat. Nos. 6,684,531 and 5,282,325 describe different types of sprung shoes. The soles are equipped with spring-loaded systems, assisting in particular the user's raising the heel during the act of walking, thereby reducing the muscle energy to be produced by the calf.

These shoes provide support for the lower limbs during the act of walking or running. The main disadvantage is that the energy released remains low, as it is more or less proportional to the energy derived from the impact of the shoe on the ground, while remaining lower or at most equal to this energy.

Document EP2699323 concerns a system for assisting the movements of a user's foot, adapted to a support a sliding board or a snowshoe. It comprises a shoe section, the front end of which is mounted such as to pivot in relation to the support and a spring securable to the support so as to rest on a bearing area of the upper, applying pressure to said bearing area when it is brought close to the support. In this case also, the energy released is a function of the energy resulting from the user's movement in addition to the stiffness of the spring. Less spring stiffness appears preferable for the user's comfort, but will provide less assistance with effort.

An aim of this disclosure is in particular to provide a device that is simple to use and put on, allowing the user to adapt the desired level of assistance to the lower limbs by an external energy input, i.e., not derived from the energy resulting from the movement of the lower limbs; the external energy input is adjustable by the user.

BRIEF SUMMARY

This disclosure, in its broadest sense, concerns a mobility assistance device comprising a first element for securing the device to a user's foot and for transmitting a thrust to the foot; and a second element connected to the first element by linking means and designed to be in contact with the ground. The device furthermore comprises means for transmitting a force derived from an exogenous energy source to the first element and/or the second element to drive the latter apart.

According to advantageous characteristics of this disclosure, taken either separately or in combination:

the first element is a first flat structure having an upper face designed to be in contact with the user's foot and a lower face opposite the second element;

the second element is a second flat structure having an upper face opposite the first element and a lower face designed to be in contact with the ground;

the upper face of the first flat structure comprises means for fastening to the uses foot;

the first flat structure forms the sole of a shoe;

the linking means comprise a hinge element serving to move the first flat structure apart from the second flat structure, by pivoting and/or by translation;

the upper face of the second flat structure is equipped with at least one rail on which the hinge element integral with mobile slides in longitudinal translation;

the mobile slides are lockable;

the means for transmitting force comprise a handle operable by a user's upper limb and interacting with a distance element forming a lever, positioned between the first and second flat structure;

the distance element comprises:

a transverse axis of rotation;

two lever arms integral at one of their ends with the transverse axis of rotation;

a spacer connecting the other ends of the lever arms, for applying the thrust to the lower face of the first flat structure.

the spacer consists of a roller bearing;

the lower face of the first flat structure features a surface minimizing the resistance of the roller of the roller bearing;

the operable handle is connected to one end of the transverse axis of rotation;

the operable handle is substantially perpendicular to the lever arms;

the link between the operable handle and the end of the transverse axis of rotation is a ratchet mechanism, or a clutch mechanism allowing adjustment of the angle between the operable handle and the lever arms;

the operable handle comprises a base integral with the transverse axis of rotation and a detachable part;

the base is a tube into which the detachable part can be inserted;

the second flat structure is equipped with a heel on its lower face.

Hence, the mobility assistance device according to this disclosure allows the user to supply energy to his/her lower limbs by operating a handle with his/her upper limbs. This energy, originating from a source that is exogenous, since external to the energy deployed by the lower limbs during movement, helps the user to raise his/her feet when advancing by steps walked or run. The intensity of the input external energy is adjustable by the user, and this intensity, which corresponds to the level of assistance, may advantageously be selected to be higher than the energy level capable of being derived from the motion of the lower limbs during movement.

According to other advantageous characteristics of this disclosure, taken either separately or in combination:

the means for transmitting force comprise an actuator operable by a motor and an electronic servo-control circuit;

the electronic servo-control circuit is connected to a sensor;

the electronic servo-control circuit is connected to a control button;

the second flat structure comprises fastening means on its lower face for securing a ski to the second flat structure;

the second flat structure is a ski;

Thus, the mobility assistance device according to this disclosure can also provide the user's lower limbs external energy, generated by an electric motor, helping him/her to lift his/her foot when moving. The mobility assistance device is also suitable for movement by gliding steps.

According to other advantageous characteristics of this disclosure, taken either separately or in combination:

the first element is a shoe;

the linking means between the first element and the second element are comprised of a bellows system, wherein the combination of the first element, the second element and the bellows system forms a cavity;

the means for transmitting force comprise a pump connected to the cavity by a tube;

the pump is capable of being operated by the user's upper limbs;

the pump is capable of being operated by an electric motor.

BRIEF DESCRIPTION OF THE DRAWINGS

This disclosure will be better understood upon reading the following description of the specific although not restrictive embodiments of this disclosure and while referring to the appended figures wherein.

DETAILED DESCRIPTION

Figure 1:
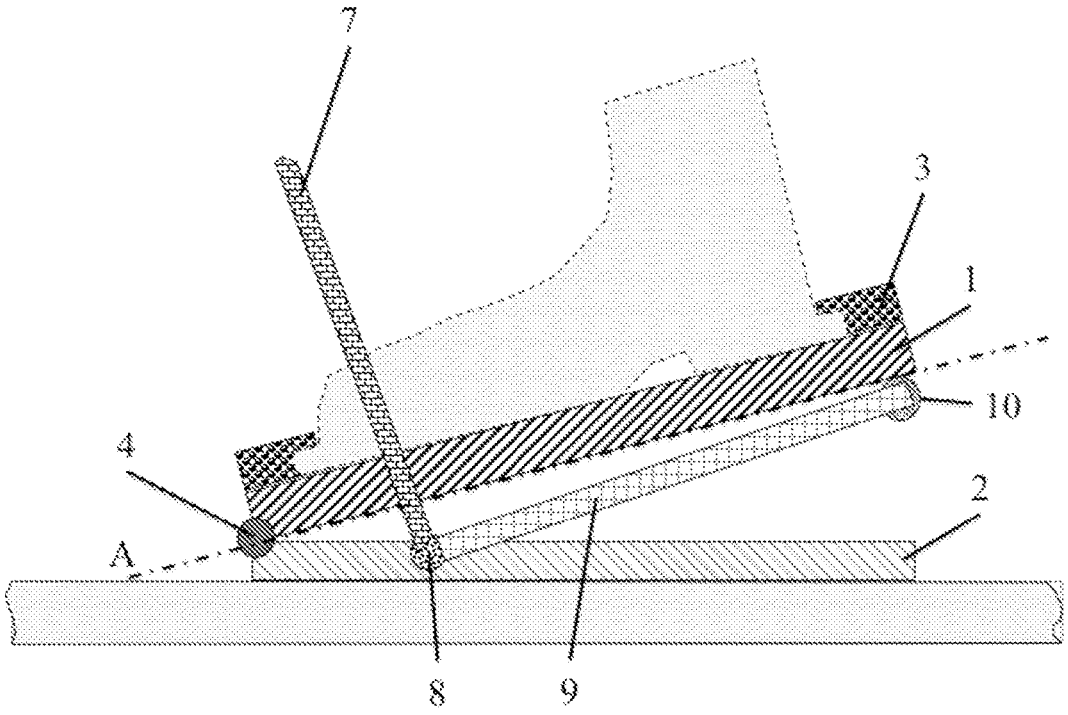
FIG. 1 presents a first embodiment of this disclosure, designed to assist movement by steps walked or run, comprising a handle operable by a user's upper limbs.

FIG. 1 illustrates a first embodiment of this disclosure. In this figure, a mobility assistance device comprises a first element consisting of a first flat structure 1, of rectangular parallelepipedal shape for example, the length of which is in the walking direction and the width of which is perpendicular to the walking direction. By way of illustration, the first flat structure 1 may have a length on the order of 15 to 35 cm and a width on the order of 5 to 15 cm. In practice, the dimensions can be adapted to the size of the user's feet and/or shoes.

The upper face of this first flat structure 1 is designed to be in contact with a user's foot.

Contact implies direct or indirect contact via a support. For instance, the upper face of the first flat structure 1 may be in direct contact with the user's foot or in indirect contact with the latter, via a shoe or another support.

The upper face of the first flat structure 1 comprises fastening means 3 serving to attach a foot or a shoe of the user. These fastening means 3 are, for example, hooks, present on the front section and the rear section of the first flat structure 1 and capable of being attached to the user's shoe. They may also be formed of straps, capable of securing the foot or the shoe.

According to an alternative embodiment, the first flat structure 1 directly consists of the sole of the shoe and in this case, it is unnecessary to have any additional fastening means.

The mobility assistance device also comprises a second element 2, forming a second flat structure 2, of a rectangular parallelepipedal shape for example, opposite the first flat structure 1 and hinged in relation to the latter. By way of illustration, the first 1 and second flat structure 2 can be manufactured from at least one light material from among:

- a type of wood
- a rigid plastic
- an aluminum- and/or titanium-based light alloy
- a carbon fiber-type composite material.

Figure 2:
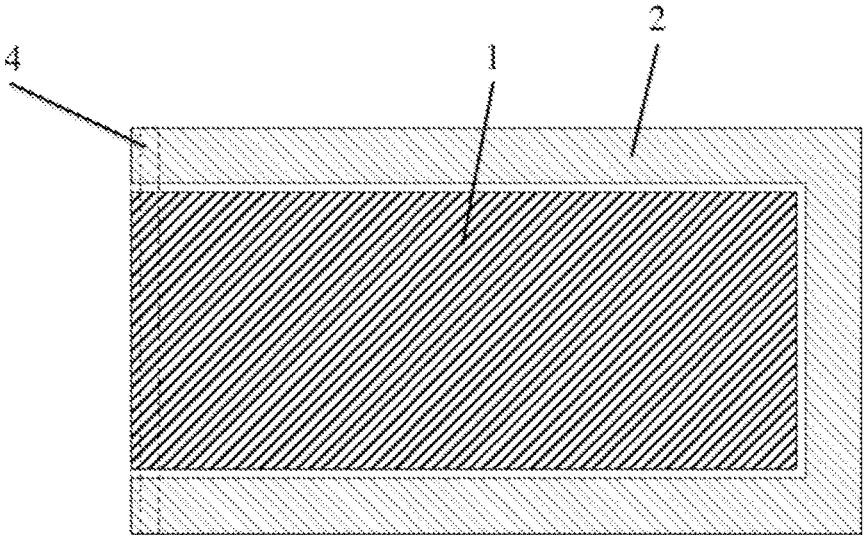
FIG. 2 shows a top view of the mobility assistance device according to the first embodiment, featuring a variation on the shape of the first and second flat structures.

According to an advantageous alternative solution, the second flat structure 2 is hollowed out and allows interlocking of the first flat structure 1, as illustrated in FIG. 2. This particular form makes for lightness of the mobility assistance device and reduces its overall dimensions.

The first flat structure 1 and the second flat structure 2 are connected by linking means 4 serving to move one apart in relation to the other, for example, by pivoting and/or by translation. This may, for example, involve a hinge fixed to the lower face of the first flat structure 1 and to the upper face of the second flat structure 2, at their front sections according to the walking direction, as illustrated in FIG. 1.

Figure 3:
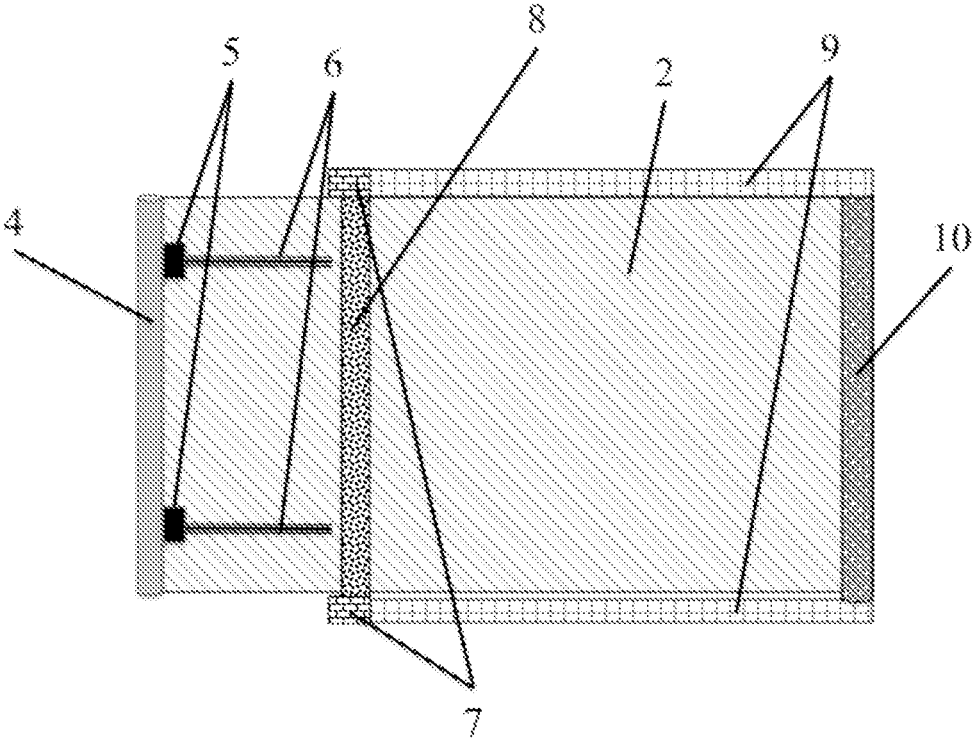
FIG. 3 shows a top view, along section plane A illustrated in FIG. 1, of the mobility assistance device according to the first embodiment.

In a variant of this embodiment, the linking means can be mounted on mobile slides 5 capable of sliding in longitudinal translation on at least one rail 6; the rail 6 is in itself fixed to the upper face of the second flat structure 2, as illustrated in FIG. 3. The mobile slides 5 are lockable, thereby allowing positioning of the linking means (for example, the axis of the hinge) between the front and median section of the second flat structure 2 and subsequently locking them during use of the device. Longitudinal translation of the linking means makes it possible to modify the position of the first flat structure 1 in relation to means 7, 8, 9, 10 for transmitting a force derived from an exogenous energy source, allowing distancing of the two flat structures from one another. The distance range can thus be adjusted according to the user's needs.

The mobility assistance device according to the first embodiment furthermore comprises the means 7, 8, 9, 10 for transmitting a force derived from an exogenous energy source, serving to move the first 1 and second flat structure 2 apart from each other.

In the entire description, an exogenous energy source will be defined as a source supplying external energy versus the energy deployed by the lower limbs during movement.

For this first embodiment in addition to the other described embodiments of this disclosure, means for transmitting a force signify means capable of receiving a force originating from an exogenous energy source and of transmitting it to the first and/or second element in the form of a thrust tending to move the latter apart from one another. This thrust is transmitted to the foot via the first element.

According to the first embodiment, these means comprise an operable handle 7 operated by the user's upper limb: the upper limb corresponds to the exogenous energy source, which will apply a force to the handle 7. The handle 7 interacts with a distance element positioned between the first 1 and second flat structure 2. This distance element constitutes a lever transmitting a force generated by operating the operable handle 7 forwards in the walking direction and tending to move the first flat structure 1 apart from the second flat structure 2, in the specific example illustrated in FIGS. 1 and 3, the distance element comprises:

- an axis of rotation, termed transverse, since perpendicular to the longitudinal axis of the second flat structure 2; this transverse axis of rotation 8 is fixed to the second flat structure 2 and moreover advantageously, situated in a front section of the latter, i.e., between the front and the median of the second flat structure 2;
- two lever arms 9 integral at one of their ends with the transverse axis 8;
- a spacer 10 connecting the other ends of the lever arms. Advantageously, the spacer 10, parallel to the transverse axis 8, is in contact with a rear section of the first flat structure 1.

When the force is transmitted from the operable handle 7 to the distance element, the spacer 10 pushes the rear section of the first flat structure 1, which tends to move the latter apart from the second flat structure 2, as illustrated in FIG. 1. The spacer 10 may advantageously comprise a roller bearing to limit friction due to the contact between the spacer 10 and the first flat structure 1. Furthermore, the lower face of the first flat structure 1, particularly in the rear area of contact with the spacer 10, may be equipped with a material minimizing the rolling resistance of the roller bearing, for example, a steel sheet 2 mm thick.

Figure 4:
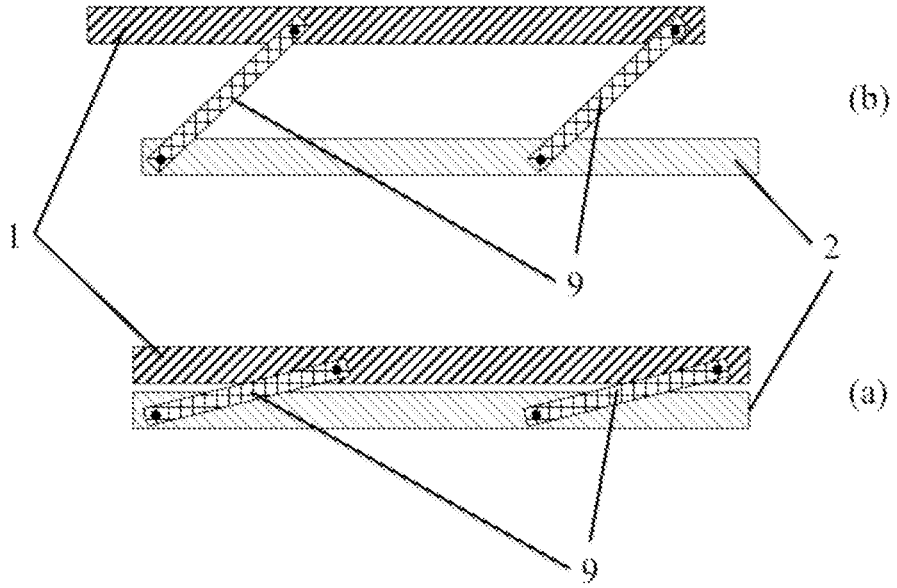
FIG. 4 shows a section view of a variation on the mobility assistance device according to the first embodiment.

According to an alternative, the linking means and the means for transmitting a force may be arranged so as to form a system of the deformable parallelogram type, allowing raising of the first flat structure 1 in relation to the second flat structure 2, as illustrated in FIG. 4. The latter illustrates, for example, a variation comprising 4 lever arms, at rest (a) and in a raised condition (b).

The operable handle 7 is connected to one end of the transverse axis of rotation 8 and runs substantially perpendicular to the lever arms 9. In a position of use, wherein the user's shoe is attached to the first flat structure 1 in its length and wherein the joint between the first 1 and second flat structure 2 is located at the front and the spacer 10 at the rear, the operable handle 7 is located on the side corresponding to the outside of the user's foot and can be gripped with the associated upper limb.

The link between the operable handle 7 and the transverse axis of rotation 8 may be fixed or adjustable, for example, by means of a ratchet mechanism or furthermore a clutch mechanism. These mechanisms allow adaptation of the handle position to the user's morphology for an ergonomic grip. By way of example, the clutch mechanism enables adjustment of the angle between the operable handle 7 and the lever arms 9, by 0.5° to 5° increments. Adjustment of this angle also allows adaptation of the thrust between the first flat structure 1 and the second flat structure 2 by altering the intensity of the force derived from the exogenous energy source.

According to a preferred alternative solution, the operable handle 7 consists of two parts: a base connected to the transverse axis of rotation 8 and a detachable part. The base may for example, be formed of a tube with an inside diameter of 2 cm and of a length of 20 cm. The detachable part may, for example, consist of a tube made of Dural, a strong and lightweight aluminum and copper alloy, with an outside diameter of 2 cm and of a length of between 90 and 150 cm.

The detachable par can be inserted into the base in order to use the mobility assistance device and transmit thrust to the lower limbs; this detachable part can also be removed from the base on terrain that does not require any external input of energy to the lower limbs.

According to this first embodiment, the mobility assistance device can be used for walking or running, on flat or sloping terrain. The user places each of his/her feet on a device, secures his/her shoes to the first flat structures 1 using the fastening means 3, with the second flat structures 2 being in contact with the ground. The user, in the resting position, has an operable handle 7 on his/her right-hand side (in relation to the device solidly secured to his/her right foot and known hereafter as the right-hand operable handle 7) and an operable handle 7 on his/her left/hand side (in relation to the device solidly secured to his/her left foot and known hereafter as the left-hand operable handle 7), which s/he can grasp to begin to advance by steps walked or run.

In a walking process, there is an alternation of temporal phases describing movement of the feet;

Phase Rn; right foot resting on the ground in position RFn, left foot moving until it reaches a more advanced position LFn Phase Ln; left foot resting on the ground in position LFn, right foot moving until it reaches a more advanced position RFn+i Phase Rn+i: right foot resting on the ground in position RFn+i, left foot moving until it reaches a more advanced position LFn+i Phase Ln+i: left foot resting on the ground in position LFn+i, right foot moving until it reaches a more advanced position RFn+2

Etc.

Correlatively, movement of the arms usually involves an alternation of forwards and rearwards swinging movements, in opposition of phase with movement of the feet:

Phase Rn; right foot resting on the ground in position RFn, left foot moving until it reaches a more advanced position LFn, right arm swinging forwards, Phase Ln: left foot resting on the ground in position LFn, right foot moving until it reaches a more advanced position Rfn+i, left arm swinging forwards, Phase Rn+i: right foot resting on the ground in position RFn+i left foot moving until it reaches a more advanced position LFn+i, right arm swinging forwards, Phase Ln+i: left foot resting on the ground in position LFn+i, right foot moving until it reaches a more advanced position RFn+2, left arm swinging forwards.

Etc.

During phase Rn, the user has his/her right foot resting on the ground; the left foot is moving to reach a more advanced position and correlatively, the right arm makes a movement forwards; s/he thus pushes the right-hand operable handle 7 forwards, generating a force transmitted by the distance element to the first flat structure 1 of the device solidly secured to his/her right foot. The first fiat structure 1 moves away from its resting position opposite the first flat structure 2 and lifts the user's right foot. This lifting initiates the movement of the right foot, the supporting foot during the Rn phase. The left foot reaches its more advanced position LFn: one subsequently proceeds to phase Ln, during which the left foot rests on the ground. The right foot is moving to reach a more advanced position RFn+1, and correlatively the user makes a forwards movement with the left arm; s/he thus pushes the operable handle 7 forwards, generating a force transmitted by the distance element to the first flat structure 1 of the device solidly secured to his/her right foot. The first flat structure 1 moves away from its resting position opposite the second flat structure 2 and lifts the users left foot. This lifting initiates the movement of the left foot, the supporting foot during the phase Ln. The right foot reaches its more advanced position RFn+i: one subsequently proceeds to phase Rn+i, during which the right foot rests on the ground. And so on.

The mobility assistance device according to this disclosure therefore provides, during each temporal phase in which most of the weight of the body rests on a given foot, external energy (generated by the movement of the arm, in this embodiment) serving to raise or help to raise the foot and facilitating the walking process.

The intensity of the energy supplied, which can be associated with the distance separating the first 1 and second flat structure 2, depends on the amplitude of movement of the arms and on the angle between the operable handle 7 and the lever arms 9 of the distance element. Thus, for an identical arm movement, the mobility assistance device according to this disclosure allows adaptation of the intensity of the energy supplied by adjusting the angle between the operable handle 7 and the lever arms 9, particularly by employing a link comprising a clutch mechanism. For example, in the resting position, if the operable handle 7 produces a 10° angle forwards in relation to the vertical position, operating the operable handle 7 by the user's upper limb during the phase of use will transmit less thrust than when the operable handle 7 is initially set to the vertical position. If, in the resting position, the operable handle 7 produces a 10° angle rearwards in relation to the vertical position, operating the operable handle by the user's upper limb during the phase of use will transmit more thrust.

According to an alternative solution particularly suitable for progression uphill with a steep incline, the second flat structure 2 can be equipped with an additional heel, allowing a reduction in the external energy input to raise or help to raise the foot and facilitating walking uphill.

The mobility assistance device according to this disclosure therefore transmits a force derived from an exogenous energy source, serving to raise or helping to raise the users foot and facilitating the walking process. It should be remembered that exogenous energy source denotes any energy that is not directly derived from the kinetic or potential energy of the movement itself; i.e., particularly from the motion or the impact of the foot on the ground during the movement. According to this embodiment of this disclosure, the exogenous energy source is the user's upper limb, which by operating the handle 7, helps to raise the foot. This is an exogenous energy source, since it can provide the thrust independently from the motion or movement of the lower limbs.

Figure 5:
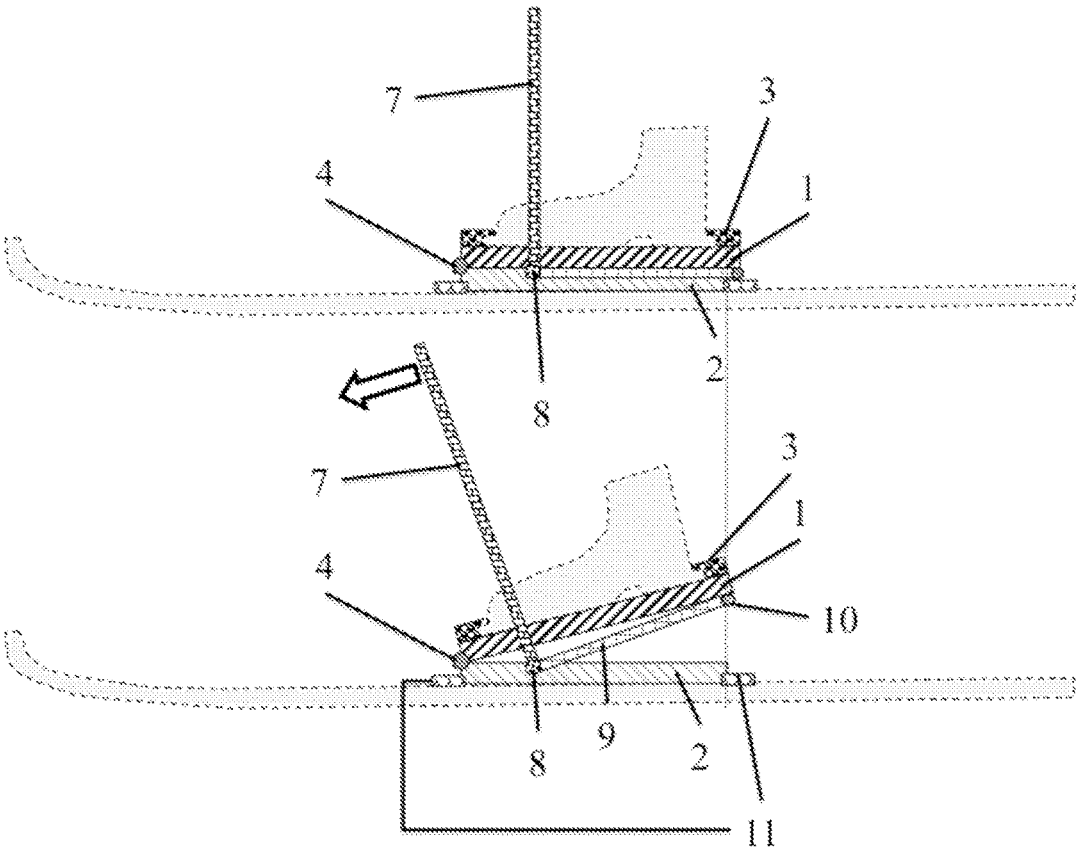
FIG. 5 presents a second embodiment of this disclosure, designed to assist movement by, gliding steps, comprising a handle operable by a user's upper limbs.

FIG. 5 illustrates a second embodiment of this disclosure.

The mobility assistance device according to the second embodiment also comprises a first element 1 forming a first flat structure 1 and a second element 2 forming a second flat structure 2, interconnected by linking means 4 allowing one to pivot in relation to the other.

The second flat structure 2 comprises fastening means 11, serving to secure its bottom surface to a ski. According to an alternative embodiment, the second flat structure 2 can be the ski itself.

The upper face of the first flat structure 1 comprises fastening means 3 serving to attach a shoe and particularly a ski boot. According to an alternative, the first flat structure 1 can be the sole of the ski boot itself.

The linking means 4 between the first 1 and second flat structure 2 in addition to the means 7, 8, 9, 10 for transmitting a force derived from an exogenous energy source, may be the same as those described in the first embodiment.

According to this second embodiment, the mobility assistance device can be used for sliding over flat or inclined terrain and in particular for ski touring or cross-county skiing travel. The user places each of his/her feet on a device, secures his/her shoes to the first flat structures 1 using the fastening means 3, with the second flat structures 2 being solidly secured to the skis. The user, in the resting position, has an operable handle 7 on his/her right-hand side (in relation to the device solidly secured to his/her right foot and known hereafter as the right-hand operable handle 7) and an operable handle 7 on his/her left-hand side (in relation to the device solidly secured to his/her left foot and known hereafter as the left-hand operable handle 7), which s/he can grasp to begin to advance by sliding steps. When advancing by sliding steps, the alternation of the temporal phases described above is observed. The mobility assistance device therefore operates in the same way as described above.

The operable handles 7 comprising a detachable part are particularly suited to this type of use: indeed, when the terrain is, for example, a downward slope, since the user no longer needs to supply external energy in order to advance, s/he can remove the detachable parts from the associated bases and use the former as conventional walking sticks, helping in particular to maintain balance.

Figure 6:
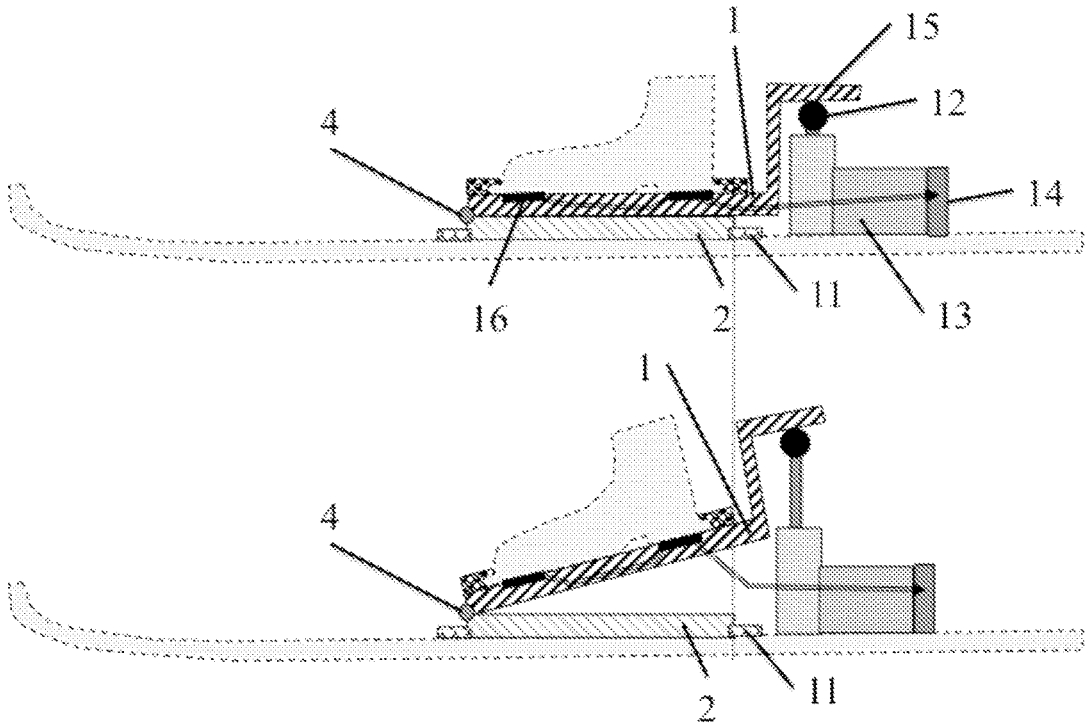
FIG. 6 presents a third embodiment of this disclosure, designed to assist movement by gliding steps, comprising an actuator operated by a motor, which is governed by a control circuit.

FIG. 6 illustrates a third embodiment of this disclosure.

This embodiment differs from those above, particularly by the means employed to transmit the force derived from an exogenous energy source serving to move apart the first 1 and second flat structure 2 of the mobility assistance device. In this embodiment, these means comprise an actuator 12 operable by a motor 13 and controlled by a servo-control circuit 14. The actuator 12 can be in a lowered, resting or top position, capable of applying a thrust. To allow this top position of the actuator 12 to transmit a thrust to the first flat structure 1, the latter comprises a stop 15 opposite the actuator 12. The servo-control circuit 14 can be connected to, for example, pressure or movement sensors 16 situated on the upper face of the first flat structure 1. Depending on the data received by the sensors 16, the circuit 14 controls the motor 13 to operate or not operate the actuator 12. The servo-control circuit 14 may also be connected to a control button that can be operated manually. When moving, the user can thus decide when s/he wishes to initiate the external energy input (derived from the motor), capable of relieving the burden on his/her lower limbs and required for his/her advancement.

The different means for transmitting a force derived from an exogenous energy source and transforming the latter into thrust tending to move apart the first 1 and second flat structure 2 of the mobility assistance device, described for the previous three embodiments according to this disclosure, can also be combined in a fourth embodiment according to this disclosure, not illustrated.

Figure 7:
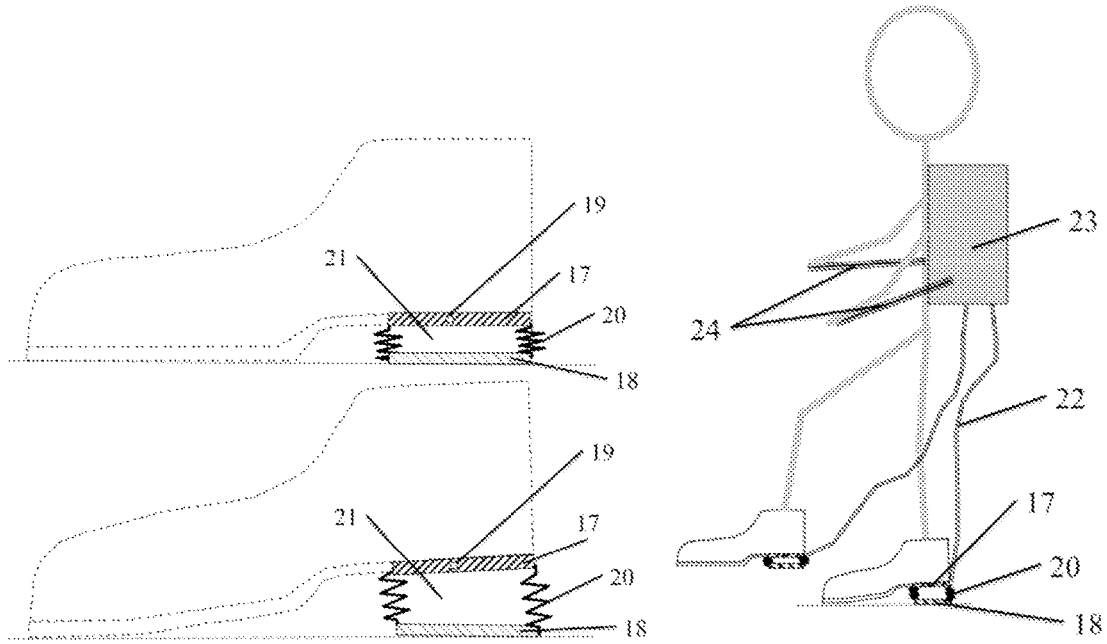
FIG. 7 presents another embodiment of this disclosure, designed to assist movement by steps walked or run.

FIG. 7 illustrates a fifth embodiment according to this disclosure.

The mobility assistance device comprises a first element 17 capable of being fixed on the heel or instead of the heel of the user. The fastening means 19 include, for example, hooks or adhesive.

The linking means between the first element 17 and the second element 18 are comprised of a bellows system 20, wherein the assembly formed of the first element, the second element and the bellows constitute a cavity 21. A tube 22 connected to this cavity 21 is linked to a pump 23, which forms part of the means for transmitting a force derived from an exogenous force and for transforming the latter into thrust tending to move apart the first element 17 and the second element 18. In the resting position, the mobility assistance device features a first element 17 and a second element 18 only a very short distance apart, wherein the bellows 20 are in the retracted position. In the active position, the pump 23 injects a fluid, for example, air, into the tube 22 in order to fill the cavity 21. Thus, the air pressure in the cavity 21 serves to move apart the first element 17 and the second element 18. This pump 23 can be operated manually or by an electric motor. For manual operation, a system of the former sulfating pump type will in particular be introduced, in which operating a lever 24 by the user's arm serves to pressurize a fluid.

According to this fifth embodiment, the mobility assistance device can be used to walk, run or slide over flat or inclined terrain.

The user attaches a first element 17 to each heel of his/her shoes. The pump 23 can be placed in a rucksack, worn by the user. If the pump 23 is operated manually, two levers 24 that can be gripped with the user's right and left hands are connected to the pump 23. The right-hand lever 24 operates the pump 23 which sends fluid into the cavity 21 of the device solidly attached to the right shoe; the left-hand lever 24 operates the pump 23 which sends fluid into the cavity 21 of the device solidly attached to the left shoe.

The alternation of the temporal phases, described above, is subsequently observed during movement.

During phase Rn, the user has his/her right foot resting on the ground; the left foot is moving to reach a more advanced position and correlatively, the right arm makes a movement downwards; s/he thus pushes the right-hand lever 24 downwards, which operates the pump and generates a force, related to the pressure of the fluid, transmitted to the first element 17 of the device solidly secured to his/her right heel. The first element 17 moves away from its resting position opposite the second element 18 and lifts the user's right heel. This lifting initiates the movement of the right foot, the supporting foot during the Rn phase. The left foot reaches its more advanced position LFn; the left arm makes a movement upwards. One subsequently proceeds to phase Ln, during which the left foot rests on the ground. The right foot is moving, to reach a more advanced position RFn+i and correlatively the user makes a movement downwards with the left arm; s/he thus pushes the left-hand lever 24 downwards, which operates the pump and generates a force, related to the pressure of the fluid, transmitted to the first element 17 of the device solidly secured to his/her left heel. The first element 17 moves away from its resting position opposite the second element 18 and lifts the user's left heel. This lifting initiates the movement of the left foot, the supporting foot during the phase Ln. The right foot reaches its more advanced position Rfn+i; the right arm makes a movement upwards. One subsequently proceeds to phase Ln+i, during which the right foot rests on the ground. And so on.

According to an alternative, the pump 23 of the fifth embodiment can be operated by an electric motor, controlled by a servo-control circuit connected to sensors. In this case, the electric motor and the servo-control circuit in addition to the connection systems can be arranged in a rucksack worn by the user.

The mobility assistance device according to this disclosure therefore transmits, during each temporal phase in which most of the weight of the body rests on a given foot, a force derived from an exogenous energy source, serving to raise or help to raise the foot and facilitating the walking process. As established above, exogenous energy source denotes any energy that is not directly derived from the kinetic or potential energy of the movement itself. As explained in the description of the different implementations of this disclosure, this exogenous energy source may correspond to the user's upper limbs or to an electric energy source.

Of course, this disclosure is not limited to the embodiments described and variant embodiments can be provided without going beyond the ambit of this disclosure as defined by the claims.

The invention claimed is:

1. A mobility assistance device, comprising:

a first element for solidly attaching the device to a user's foot and for transmitting a thrust to the foot, the first element comprising a first flat structure having an upper face to be in contact with the user's foot and lower face;

a second element connected to the first element by a linking element and designed to be in contact with the ground, the second element comprising a second flat structure having an upper face opposite the lower face of the first element and a lower face to be in contact with the ground, the second flat structure comprising a fastening device on its lower face for attaching a ski to the second flat structure; and a mechanism for transmitting a force to the first element and/or to the second element, to drive separation of the first element and the second element, the force being derived from an energy source corresponding to a user's upper limb and/or to an electric energy source.

2. The mobility assistance device of claim 1, wherein the first flat structure comprises a fastening device on its upper face for fastening the mobility assistance device to the user's foot.

3. The mobility assistance device of claim 2, wherein the linking element comprises a hinge element for moving the first flat structure away from the second flat structure.

4. The mobility assistance device of claim 3, wherein the mechanism for transmitting the force comprises an operable handle that can be operated by a user's upper limb and interacting with a distance element forming a lever, the lever positioned between the first flat structure and the second flat structure.

5. The mobility assistance device of claim 3, wherein the mechanism for transmitting force comprises an actuator operable by a motor and an electronic servo-control circuit.

6. The mobility assistance device of claim 1, wherein the first flat structure comprises a sole of a shoe.

7. The mobility assistance device of claim 1, wherein the first element is solidly attached to the heel of a shoe.

8. The mobility assistance device of claim 7, wherein the linking element between the first element and the second element comprises a bellows system, wherein a cavity is defined between the first element, the second element and the bellows system.

9. The mobility assistance device of claim 8, wherein the mechanism for transmitting force comprises a pump connected to the cavity by a tube.

10. The mobility assistance device of claim 1, wherein the linking element comprises a hinge element for moving the first flat structure away from the second flat structure.

11. The mobility assistance device of claim 1, wherein the mechanism for transmitting the force comprises an operable handle that can be operated by a user's upper limb and interacting with a distance element forming a lever, the lever positioned between the first flat structure and the second flat structure.

12. The mobility assistance device of claim 1, wherein the mechanism for transmitting force comprises an actuator operable by a motor and an electronic servo-control circuit.

13. The mobility assistance device of claim 1, wherein the linking element between the first element and the second element comprises a bellows system, wherein a cavity is defined between the first element, the second element and the bellows system.

14. The mobility assistance device of claim 13, wherein the mechanism for transmitting force comprises a pump connected to the cavity by a tube.

* * * * *